United States Patent [19]

van Boekhold et al.

[11] 4,039,885

[45] Aug. 2, 1977

[54] ELECTRIC INCANDESCENT LAMP

[75] Inventors: Johannes Leonardus Andreas Maria van Boekhold; Wilhelmus Cornelius Kessels, both of Eindhoven, Netherlands

[73] Assignee: U.S. Philips Corporation, New York, N.Y.

[21] Appl. No.: 659,417

[22] Filed: Feb. 19, 1976

[30] Foreign Application Priority Data

Feb. 22, 1975 Germany ..... 7505552[U]

[51] Int. Cl.[2] ..... H01J 1/90; H01J 19/48; H01K 1/18

[52] U.S. Cl. ..... 313/275; 313/113; 313/271; 313/333

[58] Field of Search ..... 313/271, 272, 275, 315, 313/318, 113, 331, 333

[56] References Cited

U.S. PATENT DOCUMENTS

| | | | |
|---|---|---|---|
| 2,791,714 | 5/1957 | Beesley | 313/277 X |
| 3,040,204 | 6/1962 | Belknap | 313/315 |
| 3,275,879 | 9/1966 | Demarest et al. | 313/315 X |
| 3,475,641 | 10/1969 | Ayres | 313/315 X |
| 3,611,010 | 10/1971 | Strobel | 313/315 |
| 3,725,720 | 4/1973 | Petro et al. | 313/271 X |
| 3,736,456 | 5/1973 | Middelhoek et al. | 313/315 X |

*Primary Examiner*—Saxfield Chatmon, Jr.
*Attorney, Agent, or Firm*—Frank R. Trifari; Robert S. Smith

[57] ABSTRACT

A low voltage incandescent lamp constructed from a reflector and a cover glass both consisting of pressed glass and which is referred to as a sealed beam type. Through the rear wall extend two conductors between which a filament is stretched. The filament, which may be subjected to impact is fixed by means of a bridge which comprises an electrically insulating mass through which extend two supporting wires. The supporting wires at their free ends are connected to the conductors at spaced points.

2 Claims, 5 Drawing Figures

ELECTRIC INCANDESCENT LAMP

Figure 1:
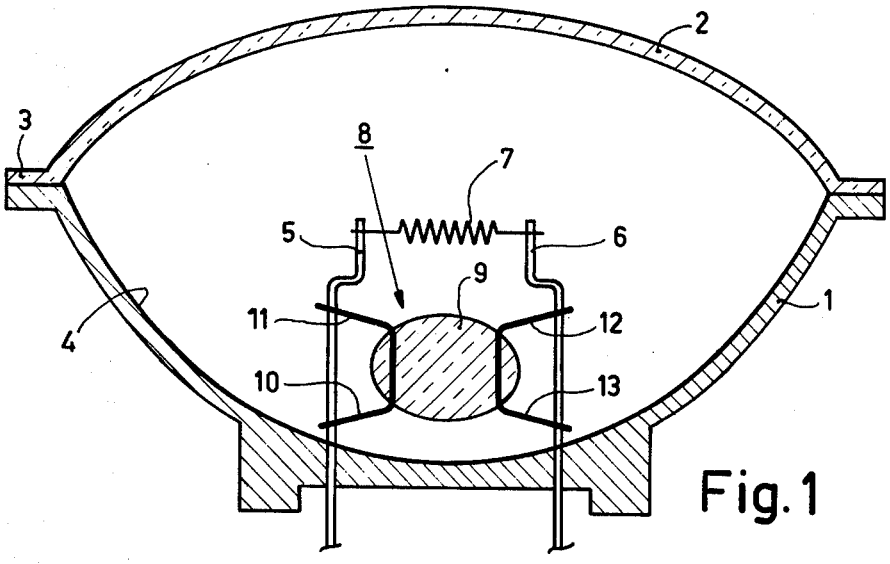

The innovation relates to an electric incandescent lamp, in particular a low voltage lamp, which comprises a hermetically sealed envelope which is constructed from parts of pressed glass and in which at least one filament is stretched between a set of current conductors secured in the wall of the envelope, in which between the filament and the connection site of the conductors a bridge is provided in the envelope and is formed as a member of electrically readily insulating material from which at least two supporting wires emanate on both sides which are secured to the conductors in places shifted in the longitudinal direction of the conductors. Such an incandescent lamp is known from United States Pat. No. 2,497,567.

The bridge used in the known lamp can be composed only manually. This is to be ascribed mainly to the shape of the bridge which is formed as a beam of rod glass. In each of the end faces thereof, a few supporting wires are secured by means of a suitable thermal treatment. The beam is softened at its ends and supporting wires of a previously determined length are secured in said ends. As a result of this a beam is obtained which shows two projecting supporting wires at each end. The projecting wires are then secured to the conductors by means of a suitable spot-welding method.

It is an object of the invention to provide a bridge construction which on the one hand can be manufactured by means of a conventional machine for the manufacture of lamp mounts and on the other hand requires less glass material while maintaining the usually required mechanical rigidity.

For that purpose the incandescent lamp according to the innovation is characterized in that the two supporting wires emanating from the member and secured to the same conductor constitute the two free ends of a supporting wire led through the member. In a bridge construction chosen in this manner the possibility is presented to secure each set of free supporting wire ends in places of the conductor farther remote from each other as is the case in the conventional bridge, while maintaining the mechanical rigidity of the assembly. The bridge is preferably formed as a glass bead having incorporated therein parallel extending supporting wires of which the free ends pointing in the same direction are connected to the conductors in a position in which they are bent apart.

An embodiment of the innovation is shown in the drawing and will be described in detail hereinafter.

Figure 2:
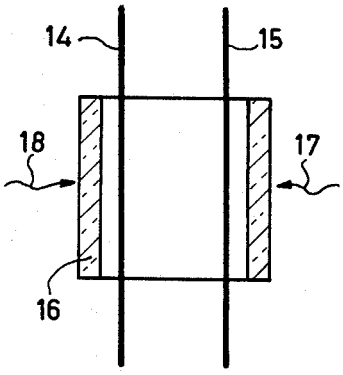
Figure 3:
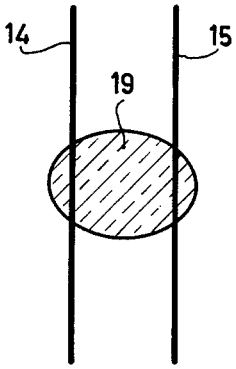
Figure 4:
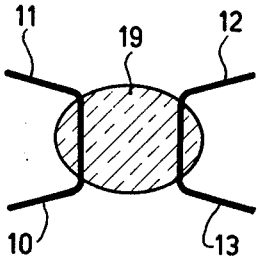
Figure 5:
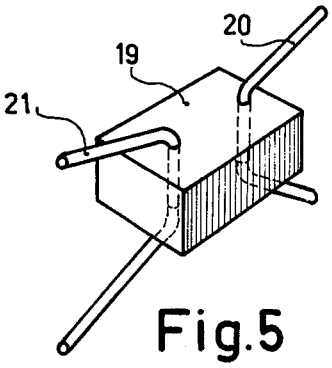

FIG. 1 is a sectional view through a low voltage incandescent lamp,

FIGS. 2, 3 and 4 relate to the manufacture of the bridge shown in FIG. 1, FIG. 5 shows another embodiment of a bridge.

The electric incandescent lamp shown in FIG. 1 is of the sealed beam type. It comprises a reflector 1 manufactured from pre-shaped pressed glass and a similar cover glass 2 sealed together at their periphery by fusion. The fusion site is denoted by 3. The reflector 1 has a reflecting coating 4 of aluminium. On its rear side the lamp comprises a usual base structure which does not form part of the innovation and will not be described in detail. Two sealed-in current lead-through members 5 and 6 project through the rear wall. A filament 7 of tungsten is stretched between the ends of the said conductors.

A bridge 8 is present between the conductors 5 and 6. During assembly of the filament and during operation of the lamp which may be subjected inter alia to impact, the filament is in this manner kept in its correct place in a fixed manner relative to the reflector surface.

The bridge 8 comprises a member 9 of glass and two continuous supporting wires 10, 11 and 12, 13. The free ends 10, 11 and 12, 13, respectively, emanating pairwise from said member 9 are connected to the conductors 5 and 6 by spot-welding, namely in places of said conductors shifted in the longitudinal direction.

The manufacture of the bridge shown in FIG. 1 is carried out as follows (see FIGS. 2, 3, 4). A glass tube 16 is provided around the two supporting wires 14 and 15. By means of flames directed according to the arrows 17 and 18, said tube 16 is fused to the wires 14 and 15 in such manner that a bead 19 (FIG. 3) is formed. The free ends of the wires 14 and 15 are then bent apart until they assume the position shown in FIG. 4.

By suitable choice of the degree of bending of the supporting wires a very stable bridge is obtained.

The advantage of this method is that it can be carried out with a conventional lamp mount machine so that the manufacture of said type of incandescent lamp can be mechanized in a simple manner.

FIG. 5 shows a bridge which is formed as a block 19 of sintered glass in which apertures are provided through which extend the supporting wires 20 and 21 whose ends have been bent apart. If desired, the block 19 may be fused to the supporting wires 20 and 21.

What is claimed is:

1. An electric incandescent lamp comprising a hermetically sealed envelope which is constructed of pressed glass, at least two current conductors, a filament stretched between said current conductors, a bridge for stabilizing the relative physical positions of said current conductors, which includes first and second support members, each member having first, second, and third axial sections, an electrically insulating body engaging each of said second axial sections to prevent relative movement therebetween, each first and third axial section of each support being disposed in oblique relation to said second axial section in each support, each of said first and third axial sections of each of said supports diverging away from said body and fixedly engaging said current conductors at axially spaced points thereof.

2. The apparatus as described in claim 1 wherein each support is planar and each support is disposed in a common plane with said second axial section of said first support being parallel to said second axial section of said second support.

* * * * *